US007568912B2

(12) United States Patent
Kubicek et al.

(10) Patent No.: US 7,568,912 B2
(45) Date of Patent: Aug. 4, 2009

(54) MULTI-PIECE CANDLE FUEL ELEMENT

(75) Inventors: Chris A Kubicek, East Troy, WI (US); Cory J Nelson, Racine, WI (US); Brian Wagers, Racine, WI (US); Paul E Furner, Racine, WI (US); Kara L Lakatos, Racine, WI (US); Thomas J Szymczak, Franksville, WI (US); Padma Prabodh Varanasi, Racine, WI (US); Joel E Adair, Racine, WI (US)

(73) Assignee: S.C. Johnson & Son, Inc., Racine, WI (US)

( * ) Notice: Subject to any disclaimer, the term of this patent is extended or adjusted under 35 U.S.C. 154(b) by 244 days.

(21) Appl. No.: 11/427,637

(22) Filed: Jun. 29, 2006

(65) Prior Publication Data

US 2006/0263734 A1 Nov. 23, 2006

Related U.S. Application Data

(63) Continuation-in-part of application No. 11/185,174, filed on Jul. 20, 2005, now Pat. No. 7,497,685, and a continuation-in-part of application No. 11/197,839, filed on Aug. 5, 2005.

(51) Int. Cl.
*F23D 3/16* (2006.01)
*F23D 3/16431* (2006.01)

(52) U.S. Cl. ..... 431/289; 431/291; 431/292

(58) Field of Classification Search ..... 431/298, 431/126, 289, 291, 292; 422/125
See application file for complete search history.

(56) References Cited

U.S. PATENT DOCUMENTS 1,390,389 A 9/1921 Rosenfeld
2,354,343 A * 7/1944 Webber et al. ..... 431/289
3,344,266 A * 9/1967 Bramson ..... 362/109
3,612,263 A * 10/1971 Doering et al. ..... 431/298
3,898,039 A 8/1975 Lin
4,427,366 A 1/1984 Moore
4,568,270 A 2/1986 Marcus et al.
5,939,005 A 8/1999 Materna
6,033,210 A 3/2000 Freeman
6,079,975 A 6/2000 Conover
6,129,771 A 10/2000 Ficke et al.
6,203,313 B1 * 3/2001 Holmes et al. ..... 431/288

(Continued)

FOREIGN PATENT DOCUMENTS

CA 2208145 12/1998

(Continued)

OTHER PUBLICATIONS

Intl. Search Report dated Oct. 13, 2006, Appl. No.PCT/US 2006/020218.

(Continued)

*Primary Examiner*—Kenneth B Rinehart
*Assistant Examiner*—Chuka C Ndubizu

(57) ABSTRACT

A candle fuel element includes a wick-holder assembly including a wick spaced from a heat-conductive element, a first fuel charge surrounding the wick, and a second fuel charge slidably engaging and at least partly surrounding the first fuel charge.

22 Claims, 7 Drawing Sheets

U.S. PATENT DOCUMENTS

| | | | | |
|---|---|---|---|---|
| 6,290,489 | B1 * | 9/2001 | Seidler | 431/289 |
| 6,328,935 | B1 | 12/2001 | Buccellato | |
| 6,669,468 | B2 * | 12/2003 | Pesu | 431/291 |
| 6,769,905 | B2 | 8/2004 | Gray et al. | |
| 6,780,382 | B2 | 8/2004 | Furner | |
| 6,802,707 | B2 * | 10/2004 | Furner et al. | 431/292 |
| 6,863,525 | B2 | 3/2005 | Byrd | |
| 7,247,017 | B2 * | 7/2007 | Furner | 431/292 |
| 2001/0031438 | A1 | 10/2001 | Hannington et al. | |
| 2003/0027091 | A1 | 2/2003 | Brandt | |
| 2003/0104330 | A1 | 6/2003 | Joyner | |
| 2004/0128879 | A1 | 7/2004 | Lu | |
| 2004/0229180 | A1 | 11/2004 | Furner | |
| 2005/0214704 | A1 * | 9/2005 | Pappas et al. | 431/126 |
| 2005/0227190 | A1 | 10/2005 | Pappas | |
| 2006/0018786 | A1 | 1/2006 | Tolman et al. | |
| 2006/0057521 | A1 | 3/2006 | Kubicek et al. | |
| 2006/0057522 | A1 | 3/2006 | Kubicek et al. | |
| 2006/0057523 | A1 | 3/2006 | Kubicek et al. | |
| 2006/0057526 | A1 | 3/2006 | Kubicek et al. | |
| 2006/0057528 | A1 | 3/2006 | Kubicek et al. | |
| 2006/0057529 | A1 | 3/2006 | Kubicek et al. | |
| 2006/0084021 | A1 | 4/2006 | Kubicek | |
| 2006/0183065 | A1 | 8/2006 | Konkle, Jr. | |
| 2006/0272199 | A1 | 12/2006 | Licciardello | |

FOREIGN PATENT DOCUMENTS

| | | |
|---|---|---|
| DE | 3302591 | 8/1984 |
| DE | 102004011919 | 6/2005 |
| EP | 0 018 839 | 11/1980 |
| EP | 1 336 799 | 8/2003 |
| GB | 161342 | 4/1921 |
| WO | WO 2006/031669 | 3/2006 |

OTHER PUBLICATIONS

Intl. Search Report dated Jul. 27, 2006, Appl. No.PCT/US 2005/032266.

U.S. Appl. No. 09/742,631, Office Action dated Aug. 18, 2003.
U.S. Appl. No. 09/747,525, Office Action dated Sep. 9, 2003.
U.S. Appl. No. 09/747,525, Office Action dated May 20, 2003.
U.S. Appl. No. 09/747,525, Office Action dated Jan. 10, 2003.
U.S. Appl. No. 09/747,525, Office Action dated Jul. 2, 2002.
U.S. Appl. No. 09/747,525, Office Action dated Oct. 1, 2001.
U.S. Appl. No. 10/780,028, Office Action dated Oct. 4, 2006.
U.S. Appl. No. 10/780,028, Office Action dated Apr. 11, 2006.
U.S. Appl. No. 10/780,028, Office Action dated Oct. 18, 2005.
U.S. Appl. No. 10/938,434, Office Action dated Jul. 17, 2006.
U.S. Appl. No. 10/978,744, Office Action dated Jul. 19, 2006.
U.S. Appl. No. 10/978,646, Office Action dated Aug. 3, 2006.
U.S. Appl. No. 10/978,744, Final Office Action dated Nov. 13, 2006.
U.S. Appl. No. 10/938,434, Final Office Action dated Nov. 20, 2006.
PCT Intl. Search Report and Written Opinion dated Dec. 6, 2006, Appl. No. PCT/US2006/028221.
PCT Intl. Search Report and Written Opinion dated Dec. 6, 2006, Appl. No. PCT/US2006/028260.
PCT Intl. Search Report and Written Opinion dated Dec. 4, 2006, Appl. No. PCT/US2006/028222.
PCT Intl. Search Report and Written Opinion dated Nov. 29, 2006, Appl. No. PCT/US 2006/031139.
PCT Intl. Search Report and Written Opinion dated Dec. 5, 2006, Appl. No. PCT/US 2006/028220.
PCT Intl. Search Report and Written Opinion dated Dec. 5. 2006, Appl. No. PCT/US 2006/027556.
Intl. Search Report and Written Opinion dated Mar. 13, 2007, Appl. No. PCT/US2006/042787.
Intl. Search Report and Written Opinion dated Mar. 21, 2007, Appl. No. PCT/US2006/046057.
U.S. Appl. No. 11/123,372, Office Action dated Feb. 27, 2007.
U.S. Appl. No. 11/124,313, Office Action dated Feb. 28, 2007.
U.S. Appl. No. 11/123,461, Office Action dated Mar. 7, 2007.
U.S. Appl. No. 11/123,809, Office Action dated Mar. 7, 2007.
U.S. Appl. No. 10/978,646, Office Action dated May 4, 2007.
Office action dated May 4, 2007, U.S. Appl. No. 10/978,646.

* cited by examiner

MULTI-PIECE CANDLE FUEL ELEMENT

CROSS REFERENCE TO RELATED APPLICATIONS

This application is a continuation-in-part of U.S. patent application Ser. No. 11/185,174, filed Jul. 20, 2005 now U.S. Pat. No.7,497,685. This application is also a continuation-in-part of U.S. patent application Ser. No. 11/197,839, filed Aug. 5, 2005. This application claims the benefit of all such previous applications and such applications are hereby incorporated herein by reference in their entirety.

REFERENCE REGARDING FEDERALLY SPONSORED RESEARCH OR DEVELOPMENT

Not applicable

SEQUENTIAL LISTING

Not applicable

BACKGROUND OF THE INVENTION

1. Field of the Invention

The present disclosure relates to candles and multi-piece candle fuel elements.

2. Description of the Background of the Invention

Candles having multiple fuel sections are known. In one candle, an oil reservoir has a circumferential ring, or collar, that sits on top of a candle support cup. The collar has a plurality of radial heat fins that slant upwardly from the periphery of the candle support cup over a fuel charge carried therein. The radial arms are circumferentially spaced around the candle support cup and conduct heat from a flame on the candle to warm the oil reservoir.

Another candle has an outer wax portion separated from a concentric inner wax portion by a cylindrical shield. A wick is disposed centrally in the inner wax portion. When a flame is disposed on the wick, the inner wax portion is burned. The shield prevents the outer wax portion from being consumed, thereby leaving the outer wax portion intact around the shield.

Another candle is a composite candle having a central core with stacked-outer rings surrounding a central core. The central core is substantially a basic pillar candle having a wick extending longitudinally through a generally cylindrical wax fuel charge. A plurality of outer wax fuel elements or wax rings are disposed around the central core stacked one on top of another up the length of the central core. When the wick is lit with a flame, heat therefrom consumes and melts both the wax fuel charge of the central core and the outer wax rings in a usual fashion. The outer wax rings have various different properties such as colors, scents, shapes, etc., and may be combined in various ways according to the taste of the user.

SUMMARY

According to one aspect of the invention, a candle fuel element includes a wick-holder assembly including a wick spaced from a heat-conductive element, a first fuel charge surrounding the wick, and a second fuel charge slidably engaging and at least partly surrounding the first fuel charge.

According to another aspect of the invention, a candle fuel element includes a wick, and a wick-holder assembly comprising a wick receiver extending upwardly from a base. A plurality of heat fins extends upwardly from the base and is spaced from the wick receiver, and a plurality of legs extend downwardly from the base, wherein the heat fins move in response to heat from a flame on the wick. A first fuel charge defines an aperture and has a first characteristic, wherein the wick receiver extends upwardly through the aperture. A second solid fuel charge defines a second aperture and has a second characteristic, wherein the first fuel charge and the wick holder assembly are slidably received in the second aperture.

DETAILED DESCRIPTION

Figure 1:
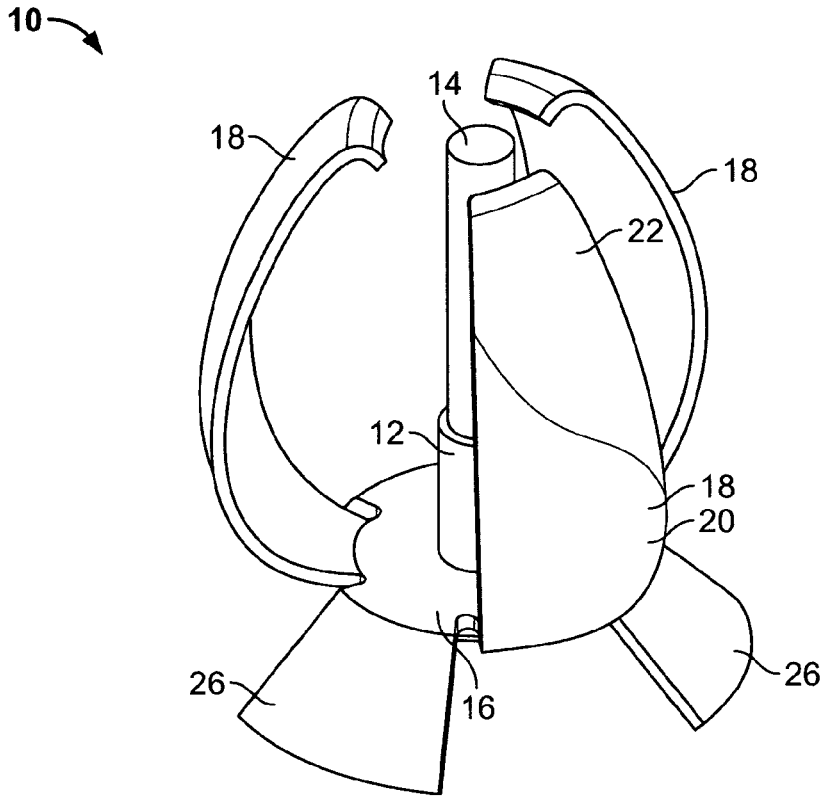
FIG. 1 is a trimetric view of a wick-holder assembly according to an embodiment of the invention.

Turning now to the drawings, FIGS. 1-5 show a wick-holder assembly 10 that includes a wick-retention member 12 for retaining a consumable or non-consumable wick 14, heat-conductive elements 18 extending upwardly from a base portion 16, and legs 26 extending downwardly from the base portion 16. The wick-retention member 12 extends upwardly from the base portion 16 and retains the wick 14 in an operative position during use. In other embodiments (not shown), the wick-retention member 12 is integral to and/or formed from one or more elements of the wick-holder assembly 10, such as for example, one or more heat-conductive elements 18. The heat-conductive elements 18 may include a number of portions, including, for example, a first portion 20 and a second portion 22 that assist in moving the heat-conductive elements in response to thermal changes. Additionally, it is contemplated that the heat-conductive elements 18 may alternatively be immobile in response to thermal changes caused by heat from a flame or other source. A capillary rib 24 is disposed underneath and extending from the base portion 16 to maintain a capillary space as described herein below.

Figure 2:
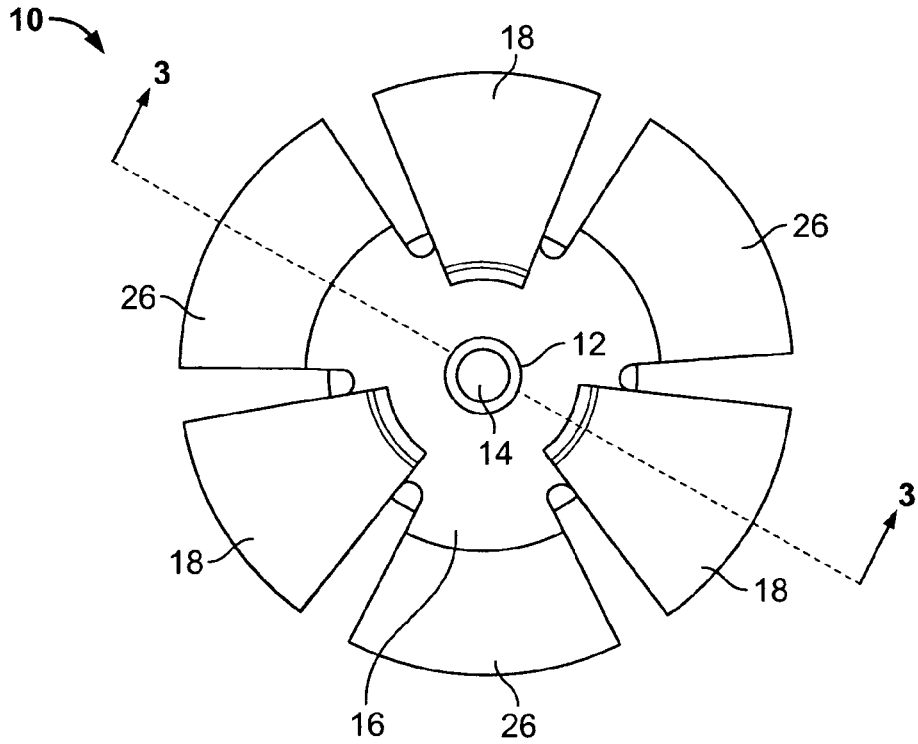
FIG. 2 is a plan view of the wick-holder assembly shown in FIG. 1.
Figure 3:
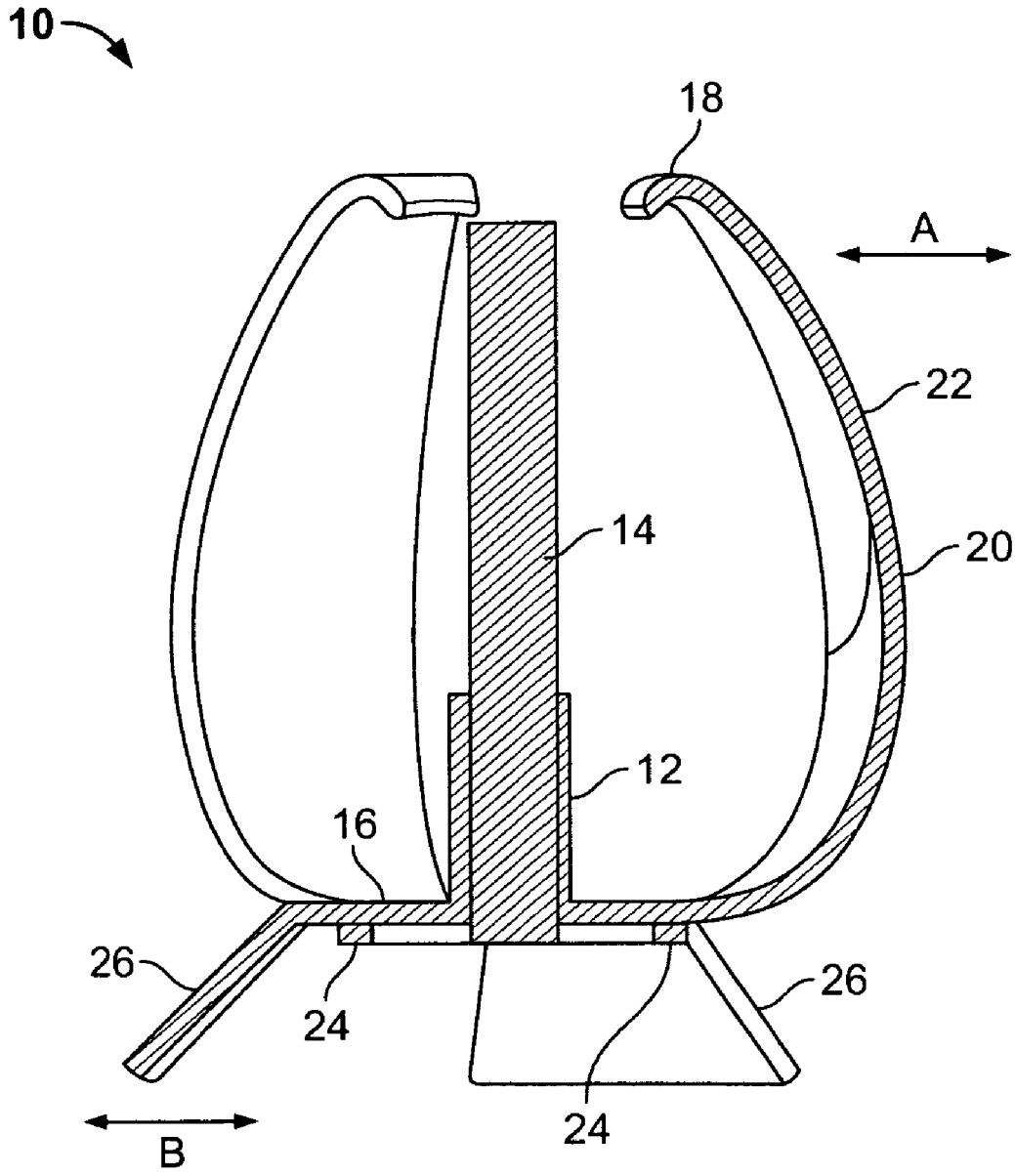
FIG. 3 is a cross-sectional view along the lines 3-3 of FIG. 2.
Figure 4:
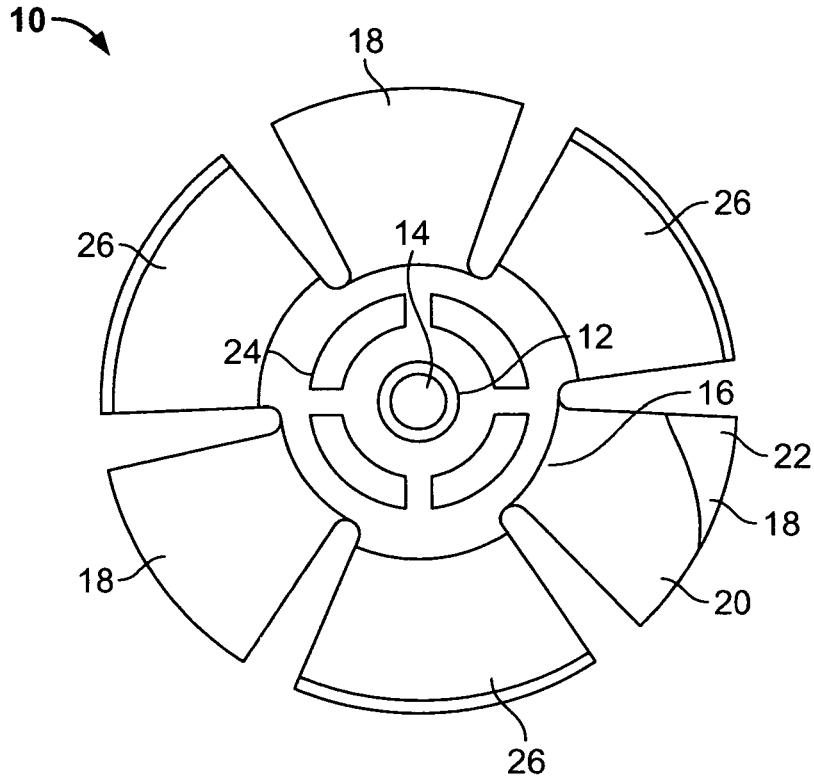
FIG. 4 is a bottom elevation view of the wick-holder assembly shown in FIG. 1.

In one embodiment of the present disclosure, the wick-retention member 12 is a cylindrical tube having open top and bottom ends that is configured to retain a consumable or non-consumable wick 14 that is configured to burn a fuel charge via capillary action. As shown in FIGS. 1-3, the wick 14 extends vertically upwardly through the open top end of the wick-retention member 12 and downwardly through the open bottom end of the base portion 16 into a capillary space (not shown) defined by a support surface (not shown) that holds the capillary rib 24, base portion 16 and legs 26 of the wick-holder assembly 10.

One or more portions of the heat-conductive elements 18, including the first portion 20 and the second portion 22, may be constructed of various materials having different thermal conductivity and/or different thermal expansion coefficients that respond to thermal changes and facilitate movement of the heat-conductive elements, for example, toward or away from a flame and as shown by an arrow A. Material useful in the present disclosure include, for example, a metal, such as aluminum, steel, nickel, magnesium, copper, iron, silver, zinc, tin, or titanium, a polyester, and a ceramic, and mixtures and combinations thereof, such as bronze, brass, copper and aluminum, and/or a copper-plated ceramic. Additionally, one or more heat-conductive elements 18 may be made of the same material or different materials. For example, one or more heat-conductive elements 18 may be constructed of a single material such as aluminum, steel, or copper, while one or more other heat-conductive elements may be constructed from two or more materials, such as a bi-metallic member having a copper portion and/or an aluminum portion, or a composite or bi-material such as polyester and aluminum or a plated ceramic material such as a metal-plated ceramic including, for example, copper plated ceramic. The other components of the wick-holder assembly 10 such as the wick-retention member 12, the base portion 16, the capillary ribs 24, and/or the legs 26 may also be made of the same material as the one or more of the heat-conductive elements 18, and in one embodiment, at least one of the heat-conductive elements, the base portion 16, the capillary ribs 24, or the legs 26 is a bi-metallic material such as copper and aluminum.

In one embodiment of the present disclosure, the first portion 20 and the second portion 22 of the heat-conductive elements 18 are constructed and arranged to move in response to a heat source such as a flame 60 (FIG. 5) disposed on the wick 14. Movement of one or more portions 20, 22 of the heat-conductive element 18 can independently be in any direction including, for example, toward or away from the heat source, upward, downward, sideways, axially, spirally, and/or directly radially from, for example, the wick-retention member 12. Movement of one or more portions 20, 22 of the heat-conductive element 18 further depends in one embodiment on the configuration and/or the amount of thermal expansion coefficient difference of the material used to construct the heat-conductive element. Moreover, movement of the heat-conductive element 18 may be influenced by the location and placement of the materials having different thermal expansion coefficients within the heat-conductive element 18. When containing materials allowing movement when exposed to heat, the shape, location, and/or distance of the heat-conductive element 18 from the heat source may also influence the movement of the heat-conductive element. For example the heat conductive element 18 may include a two-ply bi-metallic strip having an outer ply of a first material and an inner ply of a second material. The outer ply has a first thermal expansion coefficient and the inner ply has a second thermal expansion coefficient. The first and second plies are arranged such that the beat conductive element 18 moves, for example, radially inwardly, or outwardly as the heat conductive element is heated by a flame.

Figure 5:
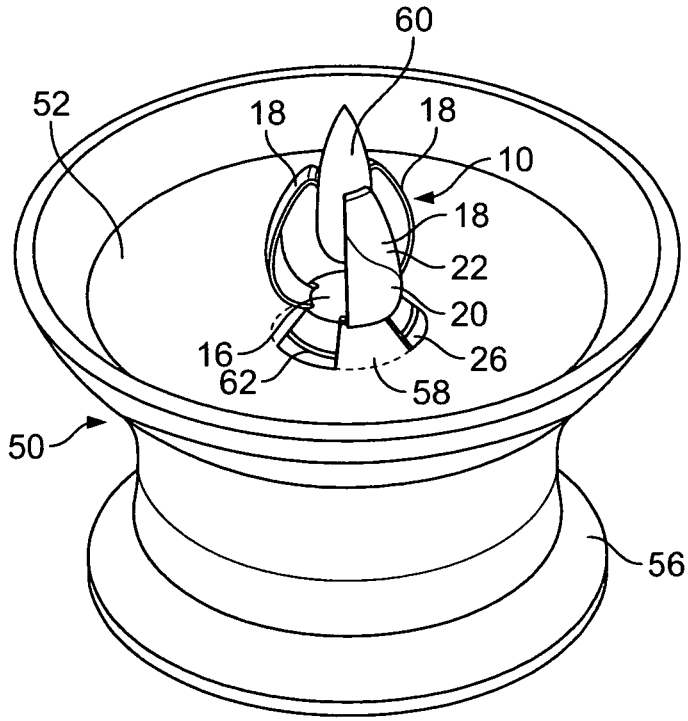
FIG. 5 is a trimetric view of the wick-holder assembly of FIG. 1 disposed in an operative position on a melting plate candle assembly.

The wick-holder assembly 10 may be disposed on any appropriate apparatus that is adapted to hold a fuel charge in conjunction with the wick-holder assembly of the present disclosure, such as the melting plate assembly 50 shown in FIG. 5. The melting plate assembly 50 includes a melting plate 52 supported by a base member 56. The base member 56 may take any desired form suitable for supporting the melting plate 52. The melting plate 52 includes a capillary lobe 58 that projects upwardly and is centrally disposed therein. In one embodiment of the present disclosure, when the wick-holder assembly 10 is operatively disposed on the melting plate assembly 50, the capillary rib 24 of the wick-holder assembly rests on the capillary lobe 58 to create a capillary space (not shown) between the wick-holder assembly and the capillary lobe. The capillary space extends between the melting plate 52 and the wick-holder assembly 10 and generally includes the area between the capillary lobe 58 and the capillary rib 24, the legs 26, and/or the base portion 16. A fuel charge (not shown for clarity), such as meltable candle wax material or liquid oil may be supported by the melting plate 52 in such proximity to the flame 60 on the wick 14 such that adequate heat transfer occurs between the flame and the fuel charge to maintain a liquid fuel source for the flame disposed on the wick until the fuel charge is mostly or entirely consumed. The capillary space allows the melted or liquid fuel to be drawn upwardly from the melting plate 52 between the wick-holder assembly 10 and the capillary lobe 58 toward the wick 14 to feed a flame 60 disposed thereon.

Illustratively, heat from the flame 60 melts the fuel charge by direct radiation convection, and/or conduction through the heat-conductive elements 18 and conduction to the melting plate 52 to form a pool of liquid fuel (not shown), such as melted candle wax, adjacent to the capillary lobe 58. The liquid fuel is drawn by capillary action through the capillary space from the melting plate 52 to the wick 14 to feed the flame 60. The wick-holder assembly 10 may be used to maintain the wick 14 in an operative position after the fuel charge has been substantially melted. In one embodiment, one or more volatile active materials including, for example, a fragrance, a musk, and/or a scent, an odor masker, a perfume, a repellant including, for example, an insect repellent, is carried by at least one fuel charge for dispersion to the surrounding environment when the fuel charge is melted and/or warmed. The wick-holder assembly 10 may also be secured to the melting plate assembly 50 by any appropriate method know to those skilled in the art, including, for example, a magnet, an adhesive, a rivet, a tape, or a weld, and/or combinations thereof. Additional details and aspects of a melting plate candle assembly are described in U.S. patent application Ser. No. 11/123,372.

Figure 6:
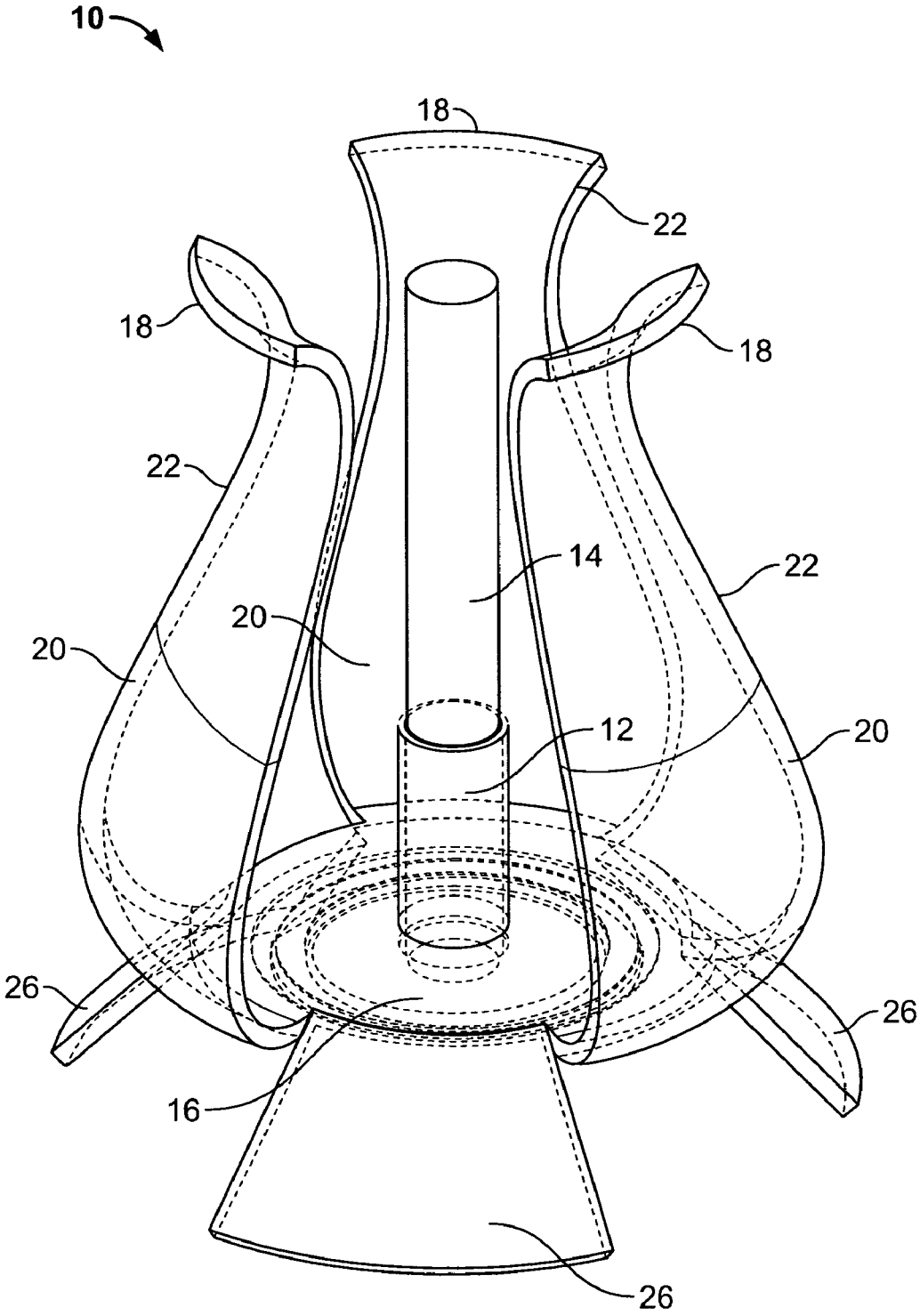
FIG. 6 is a trimetric view of a wick-holder assembly according to another embodiment of the invention.

In another embodiment, the geometry of the heat-conductive element 18 is such that the heat-conductive element substantially surrounds or partly surrounds the wick-retention member 12 and, therefore, the flame 60 supported by the fuel charge. The heat conductive elements 18 have the shape of thin strips having wide radially inward surfaces, which at least partially protect the flame 60 from surrounding air currents. Adjacent heat conductive elements 18 are circumferentially spaced, thereby allowing some fluid or air and/or wax flow and visual lines to the flame 60 therebetween. The heat conductive elements 18 may have different contour shapes. For example, the wick-holder assembly 10 shown in FIG. 6 has heat-conductive elements 18 that are generally S-shaped with an out-turned upper edge as opposed to a generally convex shape of the heat-conductive elements shown in FIGS. 1-5.

In operation, the geometry and/or the composition of one or more components of the wick-holder assembly 10 may be configured to control and/or regulate the temperature of the wick-holder assembly, the capillary space between the wick-holder assembly, a support surface holding the wick-holder assembly, such as the melting plate 52 of FIG. 5, and/or the movement of air surrounding a heat source, such as the flame 60 disposed on the wick 14. The geometry of a component generally relates to, for example, positioning of the component on the wick-holder assembly 10, movement of the component on the wick-holder assembly in response to heat generated from the flame 60, size and/or shape of the component, and/or thickness of the component.

In one embodiment, the temperature of the wick-holder assembly 10 is controlled and/or regulated, by the shape and/or the positioning of the heat-conductive elements 18. For example, to increase the temperature of the wick-holder assembly 10 while the flame 60 is lit, the heat-conductive elements 18 are shaped and/or positioned to move closer to the flame and/or to expose more surface area to the flame, which allows more heat to be transferred from the flame to the heat-conductive elements 18. From the heat-conductive elements 18, heat is then transferred to the other components of the wick-holder assembly 10. The heat of the wick-holder assembly 10 may then be transferred to the fuel charge and/or the melting plate 52, which facilitates melting and/or volatilization thereof.

In other embodiments, the capillary space between the wick-holder assembly 10 and the melting plate assembly 50 is defined and/or regulated by the geometry and/or the composition of one or more components of the wick-holder assembly. For example, in one embodiment, when one or more legs 26 are heated, one or more dimensions, for example, a length, width, and/or height of the legs are configured to move in a direction that increases and/or decreases the capillary space. Illustratively, after the wick 14 is lit and begins to generate heat, one or more dimensions of the legs 26 and/or the capillary ribs 24 increases in response to the heat. The increased dimension in one embodiment reduces the capillary space and thereby restricts flow rate of the liquid fuel charge disposed in and/or traveling through the capillary space. Additionally, or alternatively, as the flame 60 begins to produce less heat and the legs 26 and/or the capillary ribs 29 begin to cool, the one or more dimensions of the legs and/or the capillary ribs begin to decrease, thereby allowing more fuel to pass through the capillary space. By regulating the flow rate of the fuel charge, the size and/or the burn rate of the flame 60 may be regulated by changing the amount of fuel supplied to the flame.

Furthermore, by reducing the effect of air currents surrounding the flame 60, the thermal output of the flame may be maintained or enhanced in comparison to a flame without the protection of the heat-conductive element 18. In one embodiment, by maintaining or enhancing flame performance, thermal generation can be increased and/or optimized to melt and/or volatilize a fuel charge.

Changing geometry of one or more components of the wick-holder assembly 10 via a thermal response may also be used to engage, interlock and/or secure the wick-holder assembly to an apparatus such as the melting plate assembly 50 shown in FIG. 5. For example, as is seen in FIG. 3, the legs 26 may be configured to move in a direction of arrow B to grip and release a complementary pedestal by the use of differing expansion properties of a bi-metal, for example, as the wick-holder assembly 10 warms and cools. Illustratively, after the wick 14 is lit, the heat-conductive elements 18 begin to warm, and heat is transferred to the base portion 16 and legs 26. As the legs 26 begin to warm, different portions of the legs begin to expand at different rates correlated to the material of which the legs are composed. In one embodiment, the legs 26 begin to move in a direction toward the capillary lobe 58 and engage or grip a groove 62 in the melting plate 52. When the flame 60 is extinguished and the wick-holder assembly 10 cools, the legs 26 contract and return to an original position. In this embodiment, the use of other attachment methods, such as a magnet, to secure the wick-holder assembly 10 to the melting plate 52 may not be necessary.

The wick-retention member 12 in one embodiment is made of a heat-transmissive material, such as a metal, which facilitates conductive heat transfer from the flame 60 to the melting plate 52. In the embodiment shown in FIG. 3, the wick-retention member 12 is attached to the base portion 16 that includes one or more capillary ribs 24 and/or capillary channels (not shown). The shape of the capillary rib 24 shown is a raised rib extending partly around the base portion 16 and has a length, width, and/or height that facilitates capillary action of the melted and/or liquid fuel charge while the flame 60 is lit. Additionally, or alternatively, the capillary lobe 58 may have a capillary rib 24 and/or a capillary channel (both not shown), for example, on a top surface thereof, each of a shape and/or dimension to assist in the capillary movement of the melted or liquid fuel charge to the flame 60. Any other shape and/or dimension of the capillary ribs 24 and/or the capillary channels is also contemplated as long as a capillary space may be created to facilitate movement of the melted or liquid fuel charge from the melting plate 52 to the wick 14.

It is also contemplated that where the wick-holder assembly 10 has a plurality of components, members, and/or elements, for example, two or more wick-retention members 12, wicks 14, base portions 16, heat-conductive elements 18, capillary rib 24, and/or legs 26, each component, member and/or element may be independently selected and configured in regard to positioning, geometry and/or composition to achieve a desired effect such as flame intensity, burn time of the fuel charge, and/or volatilization rate of a fragrance, insecticide, and the like. It is further contemplated that the wick holder assembly 10 may have one or more components, members, and/or elements that are configured to perform one or more similar functions. In such a case, the wick holder assembly 10 may in some embodiments be constructed to be without the component, member, and/or element whose function is being performed by another component, member, and/or element. Illustratively, the heat-conductive elements 18 may be configured to be connected directly to the wick-retention member 12, thus serving one or more functions of the base portion 16 as described herein. In such an embodiment, the wick-holding assembly 10 may be constructed without the base portion 16 inasmuch as the heat-conductive element 18 is serving the function of the base portion 16.

Now turning to FIGS. 7-10, a candle fuel element 100 includes the wick-holder assembly 10, which retains the wick 14, and heat-conductive elements 18 defining lateral openings 20 therebetween. The candle fuel element 100 further includes an inner fuel charge 102 made of a first wax-like solid fuel material 106 and an outer fuel charge 202 made of a second wax-like solid fuel material 204. The inner fuel charge 102 has a central opening 104 that fits around the wick 14 and wick-retention member 12 (not visible) and an outer periphery that fits inside a circumference defined by the heat-conductive elements 18 that extend upwardly from the base portion 16. The outer fuel charge 202 has a clearance hole 206 that is sized to fit closely around the outer periphery of the heat-conductive elements 18 and the legs 26. When the outer fuel charge 202 is combined with the wick-holder assembly 10, the outer fuel charge is in slidable contact with the legs 26 and/or heat-conductive elements 18. The candle fuel element 100 is adapted for use with the melting plate candle assembly 50 including the melting plate 52 with the pedestal or raised capillary lobe 58.

Figure 7:
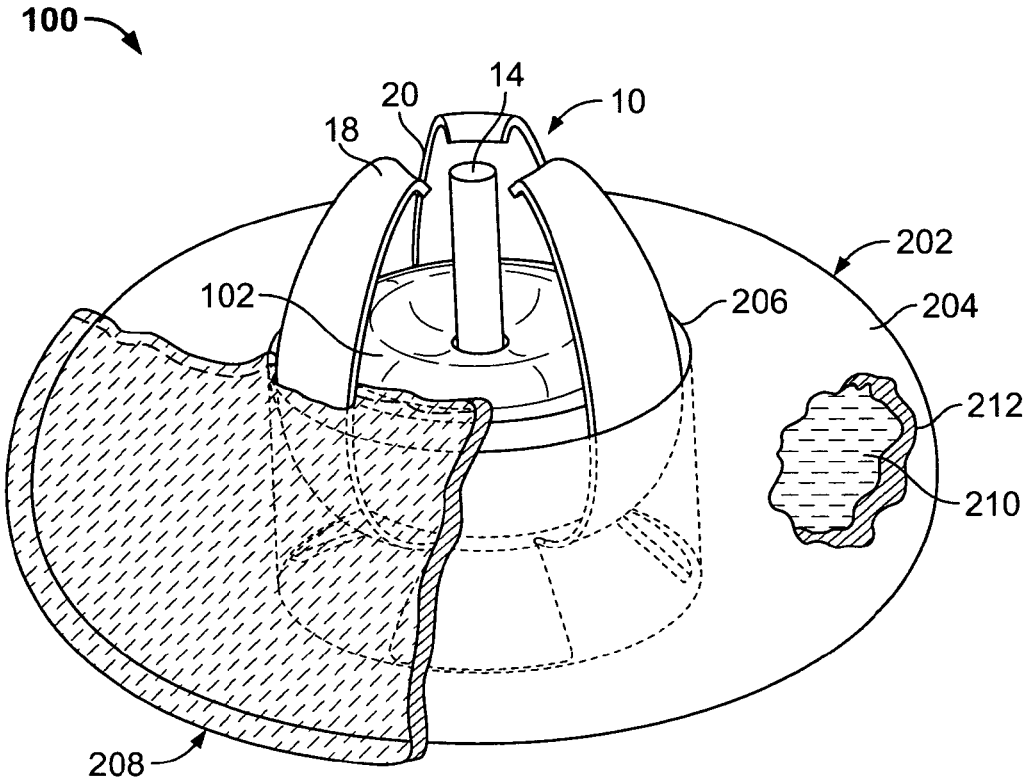
FIG. 7 is a trimetric view with portions cut away for clarity of a fuel element for a candle with an inner fuel charge, an outer fuel charge, and an additional fuel charge according to further embodiments of the invention.
Figure 8:
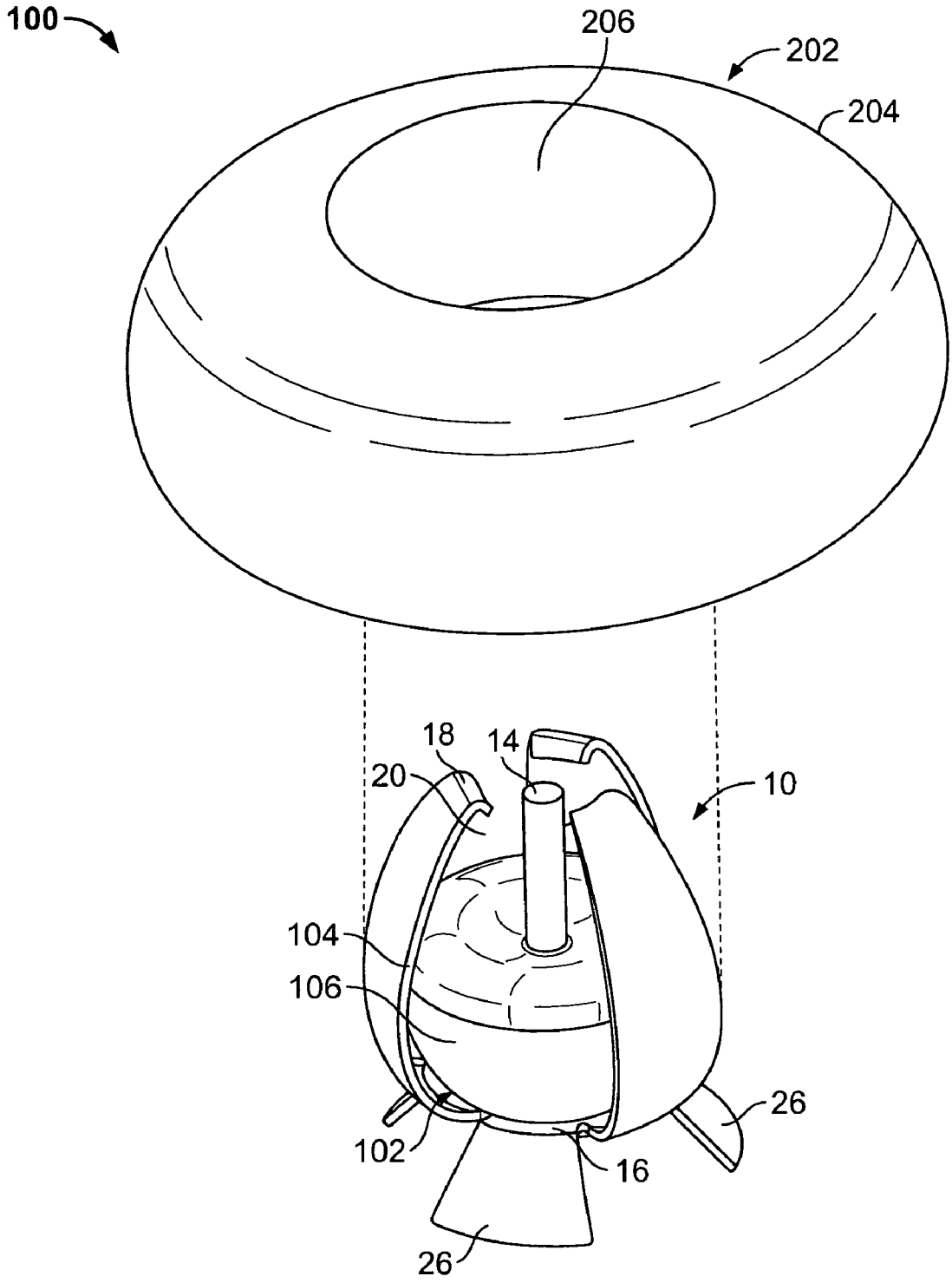
FIG. 8 is a partially exploded view of the fuel element of FIG. 7.
Figure 9:
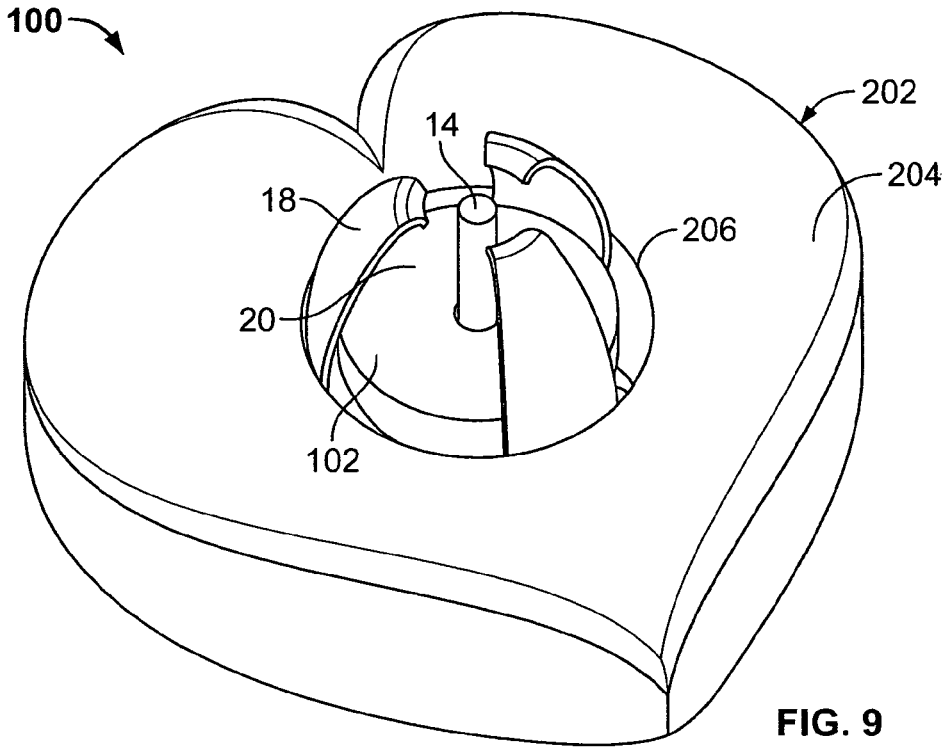
FIG. 9 is a trimetric view of a fuel element for a candle with an inner fuel charge and a heart-shaped outer fuel charge according to yet another embodiment of the invention.
Figure 10:
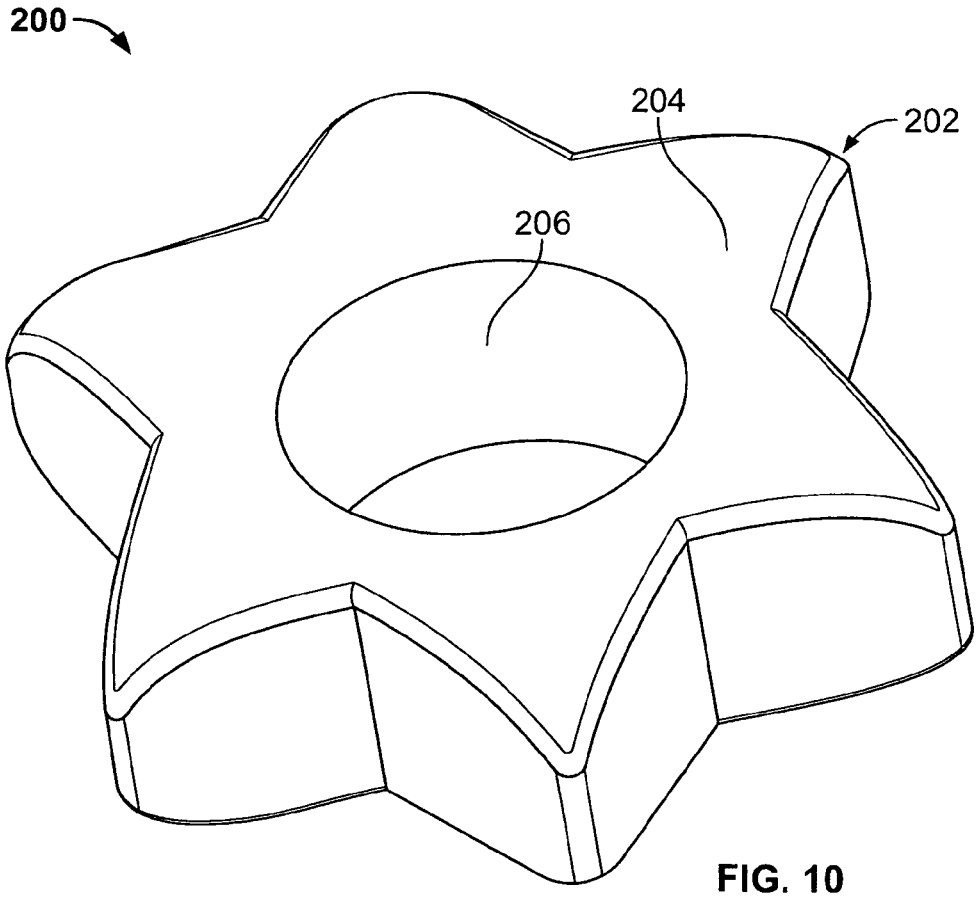
FIG. 10 is a trimetric view of a star-shaped outer fuel charge according to still another embodiment of the invention.

FIG. 7 depicts a fully assembled candle fuel element 100 with both of the inner fuel charge 102 and the outer fuel charge 202 having a generally toroidal shape. The inner fuel charge 102 and the outer fuel charge 202 may have one or more of several variable characteristics including, for example, different colors, scents, fuel types, shapes, volatile actives, and the like. The outer fuel charge 202 slides over the wick-holder assembly 10 and the inner fuel charge 102 so that a user may selectively combine different decorative shapes, fragrances, and/or colors of inner and outer fuel charges. For example, outer fuel charges 202 having different seasonal shapes among others, such as a heart or star shape as seen in FIGS. 9 and 10, respectively, may be used with the same wick-holder assembly 10 and the inner fuel charge 102. Additional outer fuel charge 202 shapes may include, for example, a triangle, a square, a cylinder, a disk, a caricature, an outline, a profile, an animal, a flower, a leaf, a word, a symbol, a custom shape, for example, a shape chosen by the user from an on-line order form, a fruit shape, etc. While only illustrated herein as a generally toroidal shape, the inner fuel charge 102 may have any number of other shapes, which may or may not be complementary to the inner periphery of the heat conductive elements 18. In one embodiment, it is contemplated that various shape themes and fragrance themes may be associated, such as, for example, when an outer fuel charge 202 has the shape of a banana, the fragrance of that outer fuel charge may have a banana-scented fragrance therewithin. Further, kits including various inner fuel charge 102 and outer fuel charge 202 combinations that combine shape and/or scent themes are contemplated. Here, differently shaped and/or scented inner fuel charges 102 and outer fuel charges 202 may be mixed and matched to form varied shape and/or scent themes. Accordingly, themes that differ only by shape, for example, combinations of inner fuel charges 102 and the outer fuel charges 202 that have the same scent are envisioned. Further, additional optional fuel charges (not shown) may be provided in the kit to provide the user with various combinations to choose from for making a shape and/or scent theme and/or for stacking the various fuel charges to create the desired shape and/or scent themes.

The shapes and scents of the inner fuel charge 102 and the outer fuel charge 202 may be combined in any order to form user customizable themes. In this embodiment, it is contemplated that such customization may be performed by way of an interactive user interface such as, a webpage, an in store interactive kiosk, or a computer program that may be downloadable over the internet or through data storage media, such as, a CD-ROM, to be installed on a user's computer. The contemplated interfaces allow the user to design the inner fuel charge 102 and/or the outer fuel charge 202 shapes and designate a volatile active material for either of the fuel charges if so desired. The user defined shape and fragrance themes may then be ordered from a manufacturer or supplier.

In another embodiment, the inner fuel charge 102 and the outer fuel charge 202 have different volatile active materials, for example, fragrances, and different melt times. For example, the inner fuel charge 102 may have a first fragrance and a first melt time and the outer fuel charge 202 may have a second fragrance and a second melt time wherein the first and second fragrances and first and second melt times are substantially different. In this example, the inner fuel charge 102 may substantially melt and release the first fragrance for a predetermined period of time before the outer fuel charge 202 begins to melt significantly and/or release a second fragrance contained therein. Illustratively, a first melt rate corresponding to the first melt time may be substantially faster and/or slower than a second melt rate corresponding to the second melt time. In this way, the candle fuel element 100 may provide a temporal fragrance release feature such that one or more fragrances may be released separately in sequence over predetermined periods of time depending upon the fragrances contained within the inner fuel charge 102 and the outer fuel charge 202 and the corresponding melt rates of the inner fuel charge and the outer fuel charge. Further, the inner fuel charge 102 and the outer fuel charge 202 may include fragrance lamina (not shown), for examples an outer layer having a first fragrance that surrounds an inner core having a second fragrance. Each of the layers and cores may have different melt rates. In this way, multiple fragrances may be emitted separately from the inner fuel charge 102 and the outer fuel charge 202 when melted by the frame 60 on the wick 14.

In yet another embodiment encompassed in FIGS. 7-10, the inner fuel charge 102 may have a first visual effect additive, such as a first colorant, and the outer fuel charge 202 may have a second visual effect additive, such as a second colorant different from the first colorant. When the inner and outer fuel charges melt, the wax will combine in a single pool to form a third visual effect, such as a third color or a mixture of the first and second color. For example, the inner fuel charge 102 may contain yellow dye, the outer fuel charge 202 may contain blue dye, and the resultant mixed pool of melted wax may have a green hue because of the mixing of the yellow wax and the blue wax or the waxes of the two fuel charges may only partly intermix such that the resultant pool has swirls of yellow wax and blue wax. In another variation, the first visual effect additive and the second visual effect additive may combine in the mixed pool to form a iridescent visual effect. In a further variation, one or both of the inner fuel charge 102 and the outer fuel charge 202 may include additives that cause a luminescent visual effect. For example, the inner fuel charge 102 may include a first visual effect additive and the second fuel charge 202 may include a second visual effect additive, which when combined together in the mixed pool of melted wax, undergo a chemical reaction that causes the pool of melted wax to be luminescent. The first and second fuel charges 102, 202, in one embodiment, would not be luminescent independently without the mixing of the first and second additives. Other separate additives to the inner fuel charge 102 and the outer fuel charge 202 may also be included to capitalize on the mixing effect of the two separate fuel charges into a common mixed pool of liquid. By using multi piece votives of different colors, a visual affect can be created when the votives melt and mix together. Also, by including different materials in the votives, other effects such as illumination or glowing of the scented oil pool can be achieved when the votives melt together.

In a further embodiment seen in FIG. 7, an additional fuel charge 208 may be added to the candle fuel element 100 that at least partly surrounds the inner fuel charge 102 and outer fuel charge 209. For example, the additional fuel charge 208 may be an at least partially transparent overlay that covers both the inner fuel charge 102 and outer fuel charge 202 or may be substantially opaque. Similar to the inner fuel charge 102 and the outer fuel charge 202, the additional fuel charge 208 may include a wax-like solid fuel material a volatile active material, and a third melt rate. Further, the additional fuel charge 208 may connect the inner fuel charge 102 to the outer fuel charge 202.

In yet a further embodiment encompassed by FIGS. 7-10, at least one of the fuel charges 102, 202, and 205 may have an inner core section 210 having a first property surrounded or encompassed by an outer covering section 212 that has a second property different from the first property. For example, the outer covering section 212 may be a solid wax, and the inner core section 210 may be a liquid fuel, such as oil, contained within the outer covering section. A fuel charge having a solid outer covering section 212 containing a liquid inner core section 212 may still be considered a solid fuel charge because it has a definite shape and form of the outer covering section, unlike a strictly liquid fuel charge, which has an amorphous shape and form. Another example is an inner core section 210 including discrete particles of fuel, such as pellets or uncompressed wax prill, and the outer covering section 212 is a compressed solid mass of the pellets or wax prill. In yet another example, the inner core section 210 may contain a first colorant and/or first volatile active, and the outer covering section 212 may contain a second colorant and/or second volatile active. In yet a further example, the inner core section 210 may include a fuel thickener, and the outer cover section 212 may not include a fuel thickener. Further examples may be found in co-pending U.S. patent application Ser. No. 11/197,839, which is incorporated by reference herein in its entirety.

In an illustrative method of operation, the wick-holder assembly 10 having an inner solid fuel charge 102 disposed between the heat-conductive elements 18 and the wick retainer tube (not shown) and wick 14, is disposed in an operative position over the capillary pedestal 58 on the melting plate 52, in a similar fashion as to that shown in FIG. 5. The outer fuel charge 202 is then slipped over the wick-holder assembly 10 through the clearance hole 206 such that the outer fuel charge rests on the melting plate 52 and is in contact with the legs 26 and/or the heat-conductive elements 18 of the wick-holder assembly. When the wick 14 is lit, heat therefrom quickly melts the inner fuel charge 102 while simultaneously heating the heat-conductive elements 18 and the legs 26 of the wick-holder assembly 10. The heated heat-conductive elements 18 and the legs 26 begin melting the outer fuel charge 202 so that once the inner fuel charge 102 is consumed, liquefied fuel (not shown) from the outer fuel charge flows by capillary action up the capillary pedestal 58 into the wick 14 to feed the flame 60. The liquefied fuel from the inner fuel charge 102 may flow outwardly through the lateral openings 20 between the heat-conductive elements 18; and, depending upon the volume of fuel in the outer fuel charge 202, the liquefied fuel from the outer fuel charge may form a pool (not shown) around the wick-holder assembly 10 and flow radially inwardly toward the inner fuel charge through the lateral openings between the heat-conductive elements. The inner fuel charge 102 may provide sufficient melted fuel (not shown) to feed the flame 60 until the outer fuel charge is melted sufficient to supply melted fuel to the flame. When an additional fuel charge 208 is present, the additional fuel charge is melted initially, at least in part, to expose the underlying inner fuel charge 102 and the outer fuel charge 202.

INDUSTRIAL APPLICABILTY

The present disclosure provides a user with a candle fuel element that is responsive to thermal changes of a flame disposed on a wick. The candle fuel element may also speed melting of a fuel charge by moving heat-conductive elements toward the flame and enhancing heat transfer from the flame to the fuel charge. The candle fuel element may also surround the flame, which reduces the impact of breezes on the flame, therefore reducing the chances of the breeze extinguishing the flame. The candle fuel element may use any combination of a first inner fuel charge and a second outer fuel charge for fueling the flame upon a wick to provide varied and customizable visual and aromatic aesthetics.

Numerous modifications will be apparent to those skilled in tile art in view of the foregoing description. Accordingly, this description is to be construed as illustrative only and is presented for the purpose of enabling those skilled in the art to make and use the disclosure and to teach the best mode of carrying out same. The exclusive rights to all modifications within the scope of the impending claims are reserved. All patents and patent applications are hereby incorporated by reference in their entirety.

We claim:

1. A candle fuel element, comprising:

a wick-holder assembly including a wick retained by an upwardly extending wick retention member spaced apart from an upwardly extending heat-conductive element;

a first solid fuel charge surrounding the wick retention member and disposed between the wick retention member and the heat-conductive element;

a second solid fuel charge slidably engaging and at least partly surrounding the first solid fuel charge; and a third fuel charge comprising a meltable solid fuel material, wherein the third solid fuel charge at least partially surrounds the first and second fuel charges, and wherein the third fuel charge connects the first and second fuel charges.

2. The candle fuel element of claim 1, wherein the heat-conductive element is disposed between the first fuel charge and the second fuel charge, and wherein the heat-conductive element defines an opening adapted to allow fluid communication between the first fuel charge and the second fuel charge.

3. The candle fuel element of claim 1, wherein the wick-holder assembly comprises a heat-conductive material that conducts heat from a flame disposed on the wick.

4. The candle fuel element of claim 1, wherein heat from a flame disposed on the wick melts a first portion of the first fuel charge and a second portion of the second fuel charge at substantially the same time.

5. The candle fuel element of claim 1, wherein the wick-holder assembly is configured to regulate via thermal expansion at least one of thermal transfer from a flame disposed on the wick to the wick-holder assembly, a dimension of a capillary space disposed between the wick-holder assembly and a support surface, movement of air surrounding the wick, engagement of the wick-holder assembly to the support surface, and thermal transfer from the flame to the first and second fuel charges.

6. The candle fuel assembly of claim 4, wherein a melted fuel travels to the wick through a capillary space up from the support surface and over a capillary pedestal via capillary action when a flame is disposed on the wick.

7. The candle fuel element of claim 1, wherein the heat-conductive element has a first portion comprising a first material with a first thermal expansion coefficient and a second portion comprising a second material with a second thermal expansion coefficient, and wherein the first material comprises at least one of a metal, a ceramic, or a polyester.

8. The candle fuel element of claim 1, wherein at least one of the first fuel charge and the second fuel charge comprises an inner core section and an outer covering section, and wherein the inner core section has a different property than the outer covering section.

9. The candle fuel element of claim 1, wherein the heat-conductive element moves in response to heat from a flame on the wick.

10. The candle fuel element of claim 1, wherein each of the first fuel charge and the second fuel charge comprises a wax-like fuel material and a volatile active material, wherein the volatile active material is independently selected for each of the first fuel charge and the second fuel charge and comprises at least one of a fragrance, a musk, a scent, an odor masker, a perfume, and a repellant.

11. The candle fuel element of claim 1, wherein the first fuel charge comprises a first volatile active and has a first melt rate, and the second fuel charge comprises a second volatile active and has a second melt rate, and wherein the first melt rate is substantially faster that the second melt rate.

12. The candle fuel element of claim 1, wherein the first fuel charge comprises a first visual effect additive and the second fuel charge comprises a second visual effect additive different from the first visual effect additive.

13. A candle fuel element, comprising:

a wick;

a wick-holder assembly comprising a wick receiver extending upwardly from a base, a plurality of heat fins extending upwardly from the base and spaced from the wick receiver, and a plurality of legs extending downwardly from the base;

a first fuel charge defining an aperture and having a first characteristic and an outer peripheral surface that fits inside a perimeter defined by the heat fins, wherein the wick receiver extends upwardly through the aperture; and a second solid fuel charge defining a second aperture and having a second characteristic, wherein the first fuel charge and the wick holder assembly are slidably received in the second aperture.

14. The candle fuel element of claim 13, wherein the heat fins define a lateral opening adapted to allow fluid communication between the first fuel charge and the second fuel charge.

15. The candle fuel element of claim 13, wherein the first fuel charge comprises a first volatile active material and has a first melt rate and the second solid fuel charge comprises a second volatile active material and has a second melt rate.

16. The candle fuel element of claim 15, wherein the first volatile active material and the second volatile active material independently comprise at least one of a fragrance, a musk, a scent, an odor masker, a perfume, or a repellant.

17. The candle fuel element of claim 13, wherein the first fuel charge has a toroidal shape and the second fuel charge has a shape comprising at least one of a toroid, a heart, a star, a heart, a triangle, a square, a cylinder, a disk, a caricature, an outline, a profile, an animal, a flower, a leaf, an indicium, a word, a symbol, a logo, a fruit, and a user defined shape.

18. The candle fuel element of claim 13, wherein the legs are adapted to grip a complementary pedestal in response to thermal changes.

19. The candle fuel element of claim 13, wherein at least one of the first fuel charge and the second fuel charge comprises an inner core section and an outer covering section, and wherein the inner core section has a different property than the outer covering section.

20. The candle fuel element of claim 13, wherein the plurality of heat fins substantially surrounds the wick receiver and the flame.

21. The candle fuel element of claim 20, wherein the plurality of heat fins have the shape of thin strips having wide radially inward surfaces, which at least partly protect the flame.

22. The candle fuel element of claim 13, wherein the heat fins move in response to heat from a flame on the wick.

* * * * *